US009611658B2

(12) United States Patent
Evans et al.

(10) Patent No.: US 9,611,658 B2
(45) Date of Patent: Apr. 4, 2017

(54) MULTI-CONFIGURABLE MODULAR DECKING SYSTEM WITH LOCKING COMPONENTS

(71) Applicants: Aimee Evans, Salt Lake City, UT (US); Heather Seals, Salt Lake City, UT (US); Matthew Hawkes, South Jordan, UT (US)

(72) Inventors: Aimee Evans, Salt Lake City, UT (US); Heather Seals, Salt Lake City, UT (US); Matthew Hawkes, South Jordan, UT (US)

( * ) Notice: Subject to any disclaimer, the term of this patent is extended or adjusted under 35 U.S.C. 154(b) by 0 days.

(21) Appl. No.: 14/590,733

(22) Filed: Jan. 6, 2015

(65) Prior Publication Data

US 2016/0312477 A1 Oct. 27, 2016

(51) Int. Cl.

| | |
|---|---|
| ***E04F 15/00*** | (2006.01) |
| ***E04F 15/02*** | (2006.01) |
| ***E04B 1/00*** | (2006.01) |
| ***E04B 1/41*** | (2006.01) |
| ***E04F 15/10*** | (2006.01) |

(52) U.S. Cl.

CPC ..... *E04F 15/02183* (2013.01); *E04B 1/003* (2013.01); *E04B 1/40* (2013.01); *E04F 15/105* (2013.01); *E04F 2201/0505* (2013.01); *E04F 2201/0523* (2013.01); *E04F 2203/026* (2013.01)

(58) Field of Classification Search

CPC ..... E04B 1/003; E04B 1/40; E04F 15/02183; E04F 2201/0523; E04F 2203/026

USPC ..... 52/177, 180, 403.1, 480, 582.2

See application file for complete search history.

(56) References Cited

U.S. PATENT DOCUMENTS

| | | | | |
|---|---|---|---|---|
| 905,189 | A * | 12/1908 | Hyke | 52/582.1 |
| 2,025,496 | A * | 12/1935 | Courtois | 404/41 |
| 2,111,003 | A * | 3/1938 | Petty | 52/603 |
| 2,493,458 | A * | 1/1950 | Koenig | 165/9.4 |
| 4,811,034 | A * | 3/1989 | Kaminskas | 343/915 |
| 5,904,021 | A * | 5/1999 | Fisher | 52/578 |
| 6,418,690 | B1 * | 7/2002 | Wheatley et al. | 52/480 |
| 6,631,603 | B2 * | 10/2003 | Zornes | 52/782.1 |
| 7,958,688 | B2 * | 6/2011 | Vilar Llop et al. | 52/582.2 |
| 2003/0145549 | A1 * | 8/2003 | Palsson et al. | 52/589.1 |
| 2004/0258869 | A1 * | 12/2004 | Walker | 428/44 |
| 2005/0252109 | A1 * | 11/2005 | Fuccella et al. | 52/177 |
| 2009/0139159 | A1 * | 6/2009 | Hill | 52/177 |
| 2009/0139160 | A1 * | 6/2009 | Hill | 52/177 |
| 2015/0075092 | A1 * | 3/2015 | Moller et al. | 52/177 |

* cited by examiner

*Primary Examiner* — Charles A Fox
*Assistant Examiner* — James Buckle, Jr.
(74) *Attorney, Agent, or Firm* — Steven Rinehart

(57) ABSTRACT

A portable, modular, interlocking decking system or apparatus that can be assembled and disassembled for resizing, transport, relocation and expansion. The decking comprises a plurality of panels shaped and dimensioned to interlock with other panels via fastener, the fastener comprising an axially rotatable locking mechanism which have detents in some embodiments.

11 Claims, 10 Drawing Sheets

MULTI-CONFIGURABLE MODULAR DECKING SYSTEM WITH LOCKING COMPONENTS

BACKGROUND OF THE INVENTION

Field of the Invention

This invention relates to a modular decking system that can be assembled and disassembled for reconfiguration, relocation, and expansion; and more particularly relates to a modular decking system comprised of panels that assemble to form a deck, anchors that uniformly bear the weight from the panels, and fastening components that rotatably lock the panels to the anchors and to the surface to restrict lateral movement therebetween.

Description of the Related Art

Installation of permanent decking requires a specialized skill set and is labor intensive, sometimes requiring footings to be dug or other construction. Traditional decks are often constructed to be a fixed in place and cannot be relocated and can only be removed or relocated through destructive means. Although modular decking kits having attachable members are known in the art, they are often fabricated from wooden members which may warp, splinter, or rot. Most modular decking comprises rectangular decking members affixed together on a subgrade, joists, beams or framing to form a larger deck. These members are not easily secured, transported and detached. Maintenance may be required to protect wooden decking from the elements and seal the surface from moisture. Variations in temperature and humidity cause them to expand and contract, which loosens the metal connection hardware. Lumber used in constructing traditional decking is also susceptible to deterioration by mildew, mold, and infestation.

In many instances, modular decking is not efficient or easily assembled in the construction of a decking. What is needed in the art is a multipurpose, lightweight decking, which does can be easily assembled, disassembled and transported; and which is suitable to withstand inclement weather, harsh environments, heavy foot traffic, and is resilient when exposed to harsh cleaning chemicals. This modular decking should also provide lateral support, comfort, and reduction of fatigue during walking or standing by users of the tile.

It is therefore desirable that a multi-configurable modular decking system be provided which overcomes these difficulties.

SUMMARY OF THE INVENTION

From the foregoing discussion, it should be apparent that a need exists for a modular decking system having unique and multi-configurable panels, anchors, locking components.

Beneficially, such a system would overcome many of the difficulties of the prior art by providing a modular decking system comprised of panels that assemble to form a deck, anchors that uniformly bear the weight from the panels while anchored into a ground or wall surface, and fasteners that rotatably lock the panels to the anchors to restrict lateral movement therebetween. The system leverages the weight of the panels, frictional forces, and fastening components to restrict lateral movement between the panels, the anchor, and a surface.

The present invention has been developed in response to the present state of the art, and in particular, in response to the problems and needs in the art that have not yet been fully solved by currently available apparatii and methods. Accordingly, the present invention has been developed to provide a modular decking apparatus that assembles to form a deck, the deck being disassemblable and portable, the decking system comprising: a plurality of hexagonal panels having a planar top surface, each panel defining six recesses circumscribing the top surface at evenly-spaced intervals, wherein each recess is shaped as a circular sector, each recess for receiving a fastener; wherein each panel further defines a plurality of apertures on the top surface; the panel further comprising an anchor affixed to a bottom surface of the panel, the anchor comprising: a plurality of fastener receptacles, each fastener receptacle having a foot for engaging a ground surface which protrudes downwardly, each fastener receptacle circumscribing an outside edge of the anchor at evenly-spaced intervals, each fastener receptacle disposed beneath a recess; a plurality of reinforced ribs disposed beneath the bottom surface, the plurality of reinforced ribs configured to enhance structural integrity of the panel; each fastener receptacle comprising an upwardly-protruding locking protrusion for engaging a fastener, the locking protrusion defining at least one locking hole; and a plurality of fasteners, each fastener for interconnecting a plurality of panels, each fastener locking over locking protrusions on separate panels.

The apparatus of claim 1, wherein each fastener comprises a cylindrical base configured to abut a fastener receptacle, the at least one fastener further comprising a cap configured to overlay the base, the cap defining at least one cap hole, wherein the at least one cap hole is configured to align with the at least one locking hole of the locking protrusion from the fastener receptacle for at least partially fastening the at the at least one anchor to the at least one panel.

The plurality of apertures in the at least one panel may be drainage holes for liquid accumulating on the top surface. In some embodiments, the top surface of the anchor engages and contour a bottom surface of the panel.

The panel and anchor may be formed as an integrated piece. The plurality of reinforced ribs may comprise perpendicularly crossing beams. The base may comprise a plurality of detents configured to frictionally engage the locking protrusion of the fastener receptacle.

The cap may be substantially circular in some embodiments. The at least one cap hole may have a hexagonal shape.

The apparatus may further comprise at least one cap fastener configured to pass through the at least one cap hole and the at least one locking hole.

The at least one cap fastener is a bolt in some embodiments. The at least one cap fastener may comprise a cap fastener hole configured to receive an Allen wrench. The cap may define a plurality of teardrop-shaped locking hole.

These features and advantages of the present invention will become more fully apparent from the following description and appended claims, or may be learned by the practice of the invention as set forth hereinafter.

BRIEF DESCRIPTION OF THE DRAWINGS

In order that the advantages of the invention will be readily understood, a more particular description of the invention briefly described above will be rendered by reference to specific embodiments that are illustrated in the appended drawings. Understanding that these drawings depict only typical embodiments of the invention and are not therefore to be considered to be limiting of its scope, the invention will be described and explained with additional specificity and detail through the use of the accompanying drawings, in which.

DETAILED DESCRIPTION OF THE INVENTION

Figure 1:
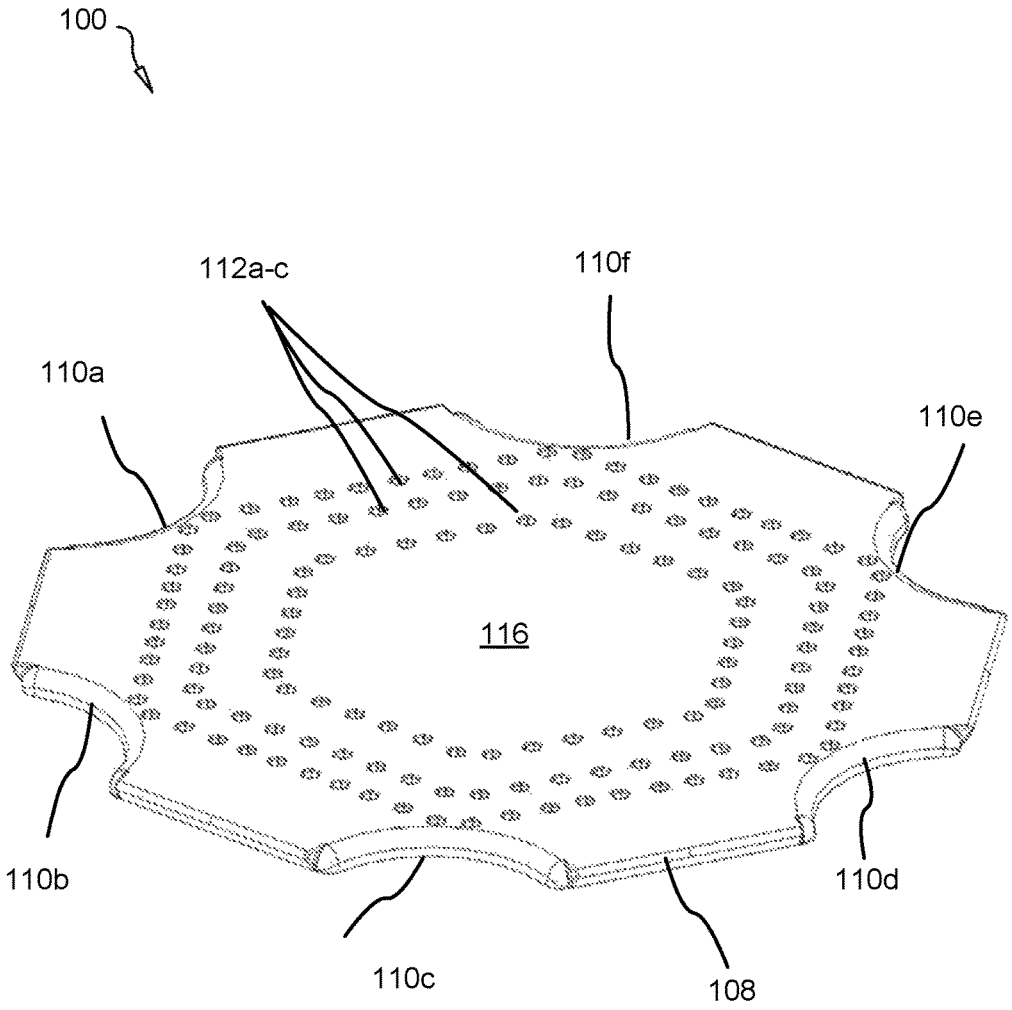
FIG. 1 is a top perspective view of a panel in accordance with the present invention.

Reference throughout this specification to "one embodiment," "an embodiment," or similar language means that a particular feature, structure, or characteristic described in connection with the embodiment is included in at least one embodiment of the present invention. Thus, appearances of the phrases "in one embodiment," "in an embodiment," and similar language throughout this specification may, but do not necessarily, all refer to the same embodiment.

Furthermore, the described features, structures, or characteristics of the invention may be combined in any suitable manner in one or more embodiments. In the following description, numerous specific details are provided to provide a thorough understanding of embodiments of the invention. One skilled in the relevant art will recognize, however, that the invention may be practiced without one or more of the specific details, or with other methods, components, materials, and so forth. In other instances, well-known structures, materials, or operations are not shown or described in detail to avoid obscuring aspects of the invention.

As referenced in FIGS. 1-9, a modular decking system 100 comprises at least one panel 102 that assembles to form a deck; at least one anchor 114 that mates with the panel 102 to uniformly bear the dead and/or live load weight from the panel 102 while anchored into a ground or wall surface; and at least one fastener 132 that rotatably locks the panel 102 to the anchor 114 to restrict lateral movement therebetween.

The anchors 114 position at a panel periphery 108 on each panel 102. The generally peripheral positioning of the anchors 114 and interconnections allow for a more uniform weight distribution of a load on the decking. Additionally, the fastener 132 creates a lock through frictional forces while also providing tactile feedback to indicate when the panel 102 and the anchor 114 are locked into place. The fastener 132 also requires minimal special tools or skillset to lock or remove.

In some embodiments, the system 100 comprises at least one panel 102 and at least one anchor 114 that have substantially the same contour shape. The substantially same contour shape enables for intuitive and facilitated mating therebetween. The panel 102 and the anchor 114 interlock together at the panel periphery 108 and at an anchor periphery 122 through at least one fastener 132. The fastener 132 uses a rotatable locking mechanism having a plurality of detents 140. The detents 140 create frictional forces against the anchor and the panel to form a snug fit therebetween. The detents 140 also create tactile feedback during rotation of the fastener 130 to indicate when the locking is complete.

The fastener 132 has at least one cap hole 138 that can be aligned with at least one locking hole 130 in the anchor 114. Once aligned, at least one cap fastener 152 can pass through the holes 130, 138 to further secure the lock. In this manner, the interlocking connections are doubly secured while still maintaining their simplicity to form the interlocking interaction between panels 102 and anchors 114.

In some embodiments, the at least one panel 102 forms a substantial portion of the deck's surface. The at least one anchor 114 uniformly supports the dead and/or live load weight from the panel 102. The points of interconnection where the fasteners 132 lock the panels 102 and anchors 114 occur at the panel recessions 110*a*-110*f* and the anchor recessions 124*a*-124*f*. Because the interconnections with the anchor 114 occur at the peripheries 108, 122, the load on the decking is more uniformly distributed.

Additionally, each panel 102 is secured in place to the anchor 114 by at least one fastener 132 that engages the anchor 114 at a plurality of anchor recessions 124*a*-124*f* on the anchor periphery 122. The fasteners 132 rotatably lock the panel 102 to the anchor 114 through frictional engagement, detents 140 that snap together and provide tactile feedback, and additional fastening components that pass through at least one locking hole 130 at the anchor recessions 124*a*-124*f* and at least one cap hole 138 at the fastener 132. In one embodiment, six anchors 114 support a single panel 102 and any number of adjacent panels 102. The use of six anchors 114 and six correlating fasteners 132 is consistent with the hexagonal shape of the panel 102. However, in other embodiments, any number of anchors 114 and fasteners 132 may be used.

As referenced in FIG. 1, the system 100 comprises at least one panel 102. The panel 102 is configured to interlock with additional panels 102 to form the decking. In some embodiments, the decking may include a floor decking, a wall, a patio, a pier, or a boat deck. The panel 102 is defined by a panel bottom surface 104 and a panel top surface 106. The panel 102 may have a generally flat, hexagonal shape. Though in other embodiments, other shapes for the panel 102 may include, without limitation, a pentagonal, cube, triangle, and rectangle shape. Suitable materials for the panel 102 may include, without limitation, composite lumber, polymeric resins, polyvinyl chloride, virgin polyvinyl chloride, virgin/reclaimed polyvinyl chloride mixtures, compression molded rubber, rigid polymers, hard wood, soft wood, and a combination of wood fiber, plastic, and binding agents.

The panel 102 is further defined by a panel periphery 108 having a plurality of panel recessions 110*a*-110*f*. The panel recessions 110*a*-110*f* may form a substantially half-circle shape at evenly-spaced sections of the periphery of the panel 102. The at least one panel 102 also includes a plurality of apertures 112*a*-112*c* that are efficacious for enabling water, ice, or debris to pass through. One example of the apertures 112*a*-112*c* includes drainage or weep holes passing through the panel 102 serve to shed and disperse water from the deck. The plurality of apertures 112*a*-112*c* can take any number of shapes, and may be pre-molded, pre-drilled, or otherwise pre-made with the panel 102.

Figure 2:
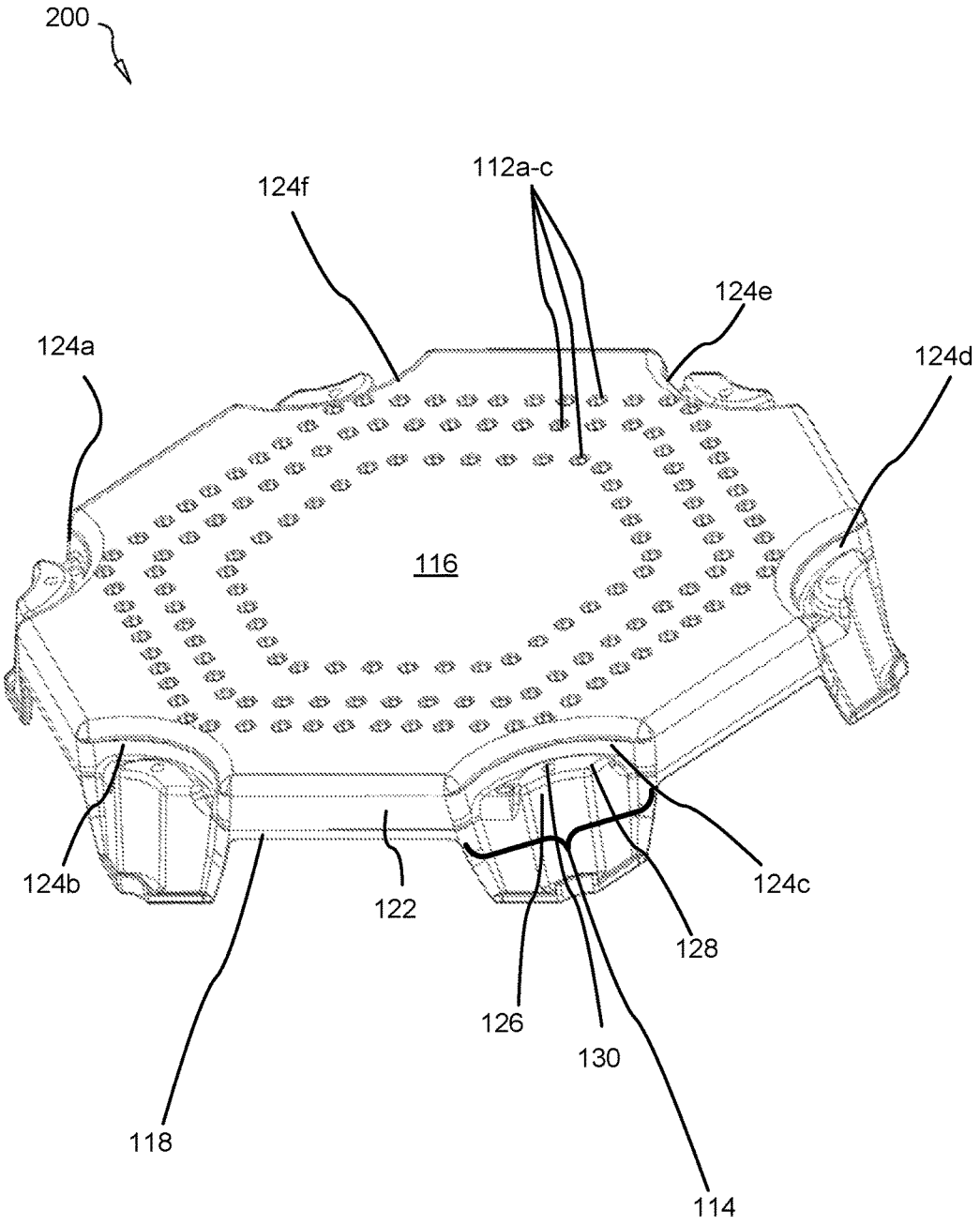
FIG. 2 is a top perspective view of a panel mated with an anchor in accordance with the present invention.

Turning now to FIG. 2, the system 100 is shown to include at least one anchor 114. The anchor 114 is defined by an anchor top surface 116, an anchor bottom surface 118, and a cavity (not shown). In some embodiments, the anchor 114 is configured to have substantially the same contour shape as the panel 102, whereby the panel 102 mates with the anchor 114. The anchor 114 receives the panel 102 at the anchor top surface 116, thereby engaging the panel bottom surface 104. An anchor periphery 122 aligns flush against a panel periphery 108 when the panel 102 and anchor 114 engage. The panel 102 may be secured, via adhesive, molded attachment, or other means, to the anchor 114, concealing all of its fastening components and substantially all of the panel bottom surface 104 and the anchor top surface 116.

The anchor 114 is designed to support the panel 102, maximizing support for the panel 102 and uniformly distributing dead and/or live load weight onto a ground or wall surface. Because the anchor 114 attaches to the panel periphery 108, specifically at the plurality of panel recessions 110*a*-110*f*, the weight on the decking is uniformly distributed. Furthermore, since six anchors 114 may be used, the weight is further distributed, since it is known that the larger the number of supports, the more uniform is the weight distribution.

The anchor 114 fastens to a ground or wall surface at the anchor bottom surface 118. In some embodiments, the anchor 114 rests on a grade or level surface and is considered a temporary structure, allowing the system 100 to be utilized by more than just building component.

Figure 3:
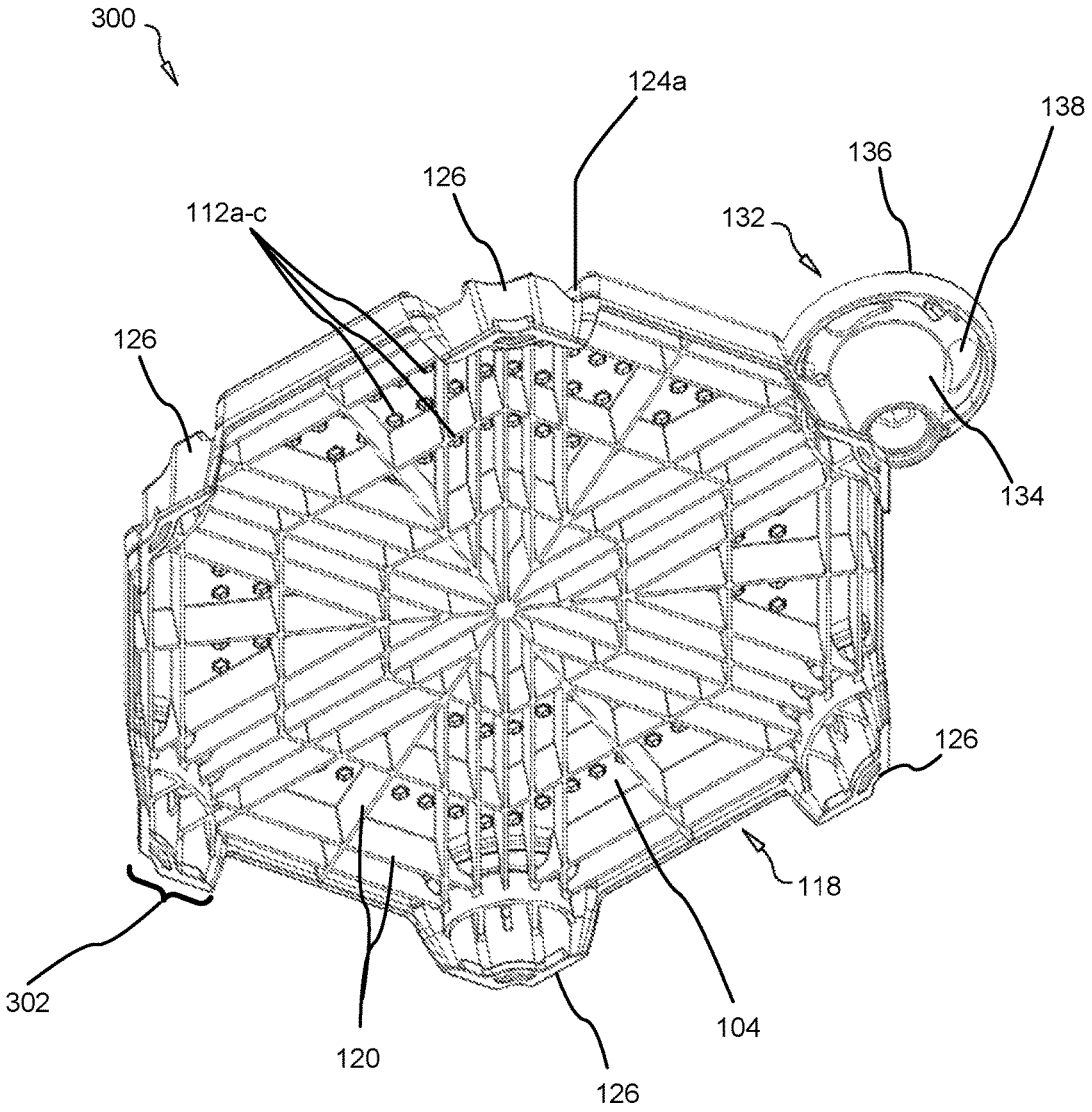
FIG. 3 is a bottom perspective view of a panel in accordance with the present invention.

As illustrated in FIG. 3, the anchor 114 forms a cavity that enables it to be portable and lightweight. To further reinforce the anchor 114 without significantly increasing its weight, the cavity in the anchor 114 is filled with a reticulated structure, such as a plurality of reinforced ribs 120. The plurality of reinforced ribs 120 are configured to enhance the structural integrity of the anchor 114. The ribs 120 serve to further distribute the live and dead load weight from the panel 102 to the anchors 114. The ribs 120 may include a crosslinking series of barriers that fill the cavity. The crosslinking configuration serves to resist lateral and compressive forces that tend to destabilize the anchor 114.

Those skilled in the art, in light of the present teachings, will recognize that by creating structural integrity in the cavity of the anchor 114 through ribs 120, rather than filling the cavity with a solid material, the weight of the anchor 114 is reduced while still maintaining strength and stability. Additionally, the reinforced ribs 120 establish an exact, consistently-spaced gap between adjacent panels 102, allowing for water drainage and air circulation.

The anchor 114 is further defined by a plurality of anchor recessions 124*a*-124*f* at the anchor periphery 122. The anchor recessions 124*a*-124*f* have substantially the same contour shape as the panel recessions 110*a*-110*f*, thereby enabling a flush surface with the panel periphery 108 while the panel 102 and the anchor 114 are engaged.

Each anchor recession 124*a*-124*f* has a fastener receptacle 126 that integrates therein. The fastener receptacle 126 forms a substantially wing shaped extension to the anchor recessions 124*a*-124*f*. Due to this unique wing shaped configuration, the fastener receptacle 126 provides a locking surface for the various fastening components to engage. The fastener receptacle 126 forms a stable surface for receiving fastening components. Thus, frictional engagement works with the detents 140 in the fastening components to lock the fastener 132 into the fastener receptacle 126.

In one embodiment, the fastener receptacle 126 includes a locking protrusion 128 that extends perpendicularly from the fastener receptacle 126. The locking protrusion 128 provides yet another locking mechanism to secure the fastener 132 to the fastener receptacle 126. At least one locking hole 130 is disposed to cross transversely across the locking protrusion 128. The locking hole 130 enables passage of fastening components that help secure the panel 102 to the anchor 114.

Each fastener receptacle 126 extends transversely across the anchor 114. The fastener receptacle 126 is disposed to extend beyond the anchor bottom surface 118. In this manner, the fastener receptacle 126 forms an extension that orients perpendicularly to the anchor 114. The fastener can be used to penetrate the ground or wall surface for anchoring. For example, six fastener receptacles 126 on the anchor periphery 122 penetrate the ground surface until the anchor 114 is level and stable relative to the ground surface. However in other embodiments, the fastener receptacle 126 may attach to the ground or wall surface through other means, including, without limitation, screws, nails, magnets, ropes, and adhesives.

It is significant to note that the panel 102 and the anchor 114 have a lightweight construction, being made of lightweight plastic or another composite material, with each panel 102 and each anchor 114 manufactured as individual single pieces. One possible form of manufacturing may include injection molding, although compression molding or any other suitable technique for molding polymeric resin may also be used. Additionally, during fabrication, the panel 102 and the anchor 114 may be reinforced by pulling reinforced fibers through the resin.

Figure 4:
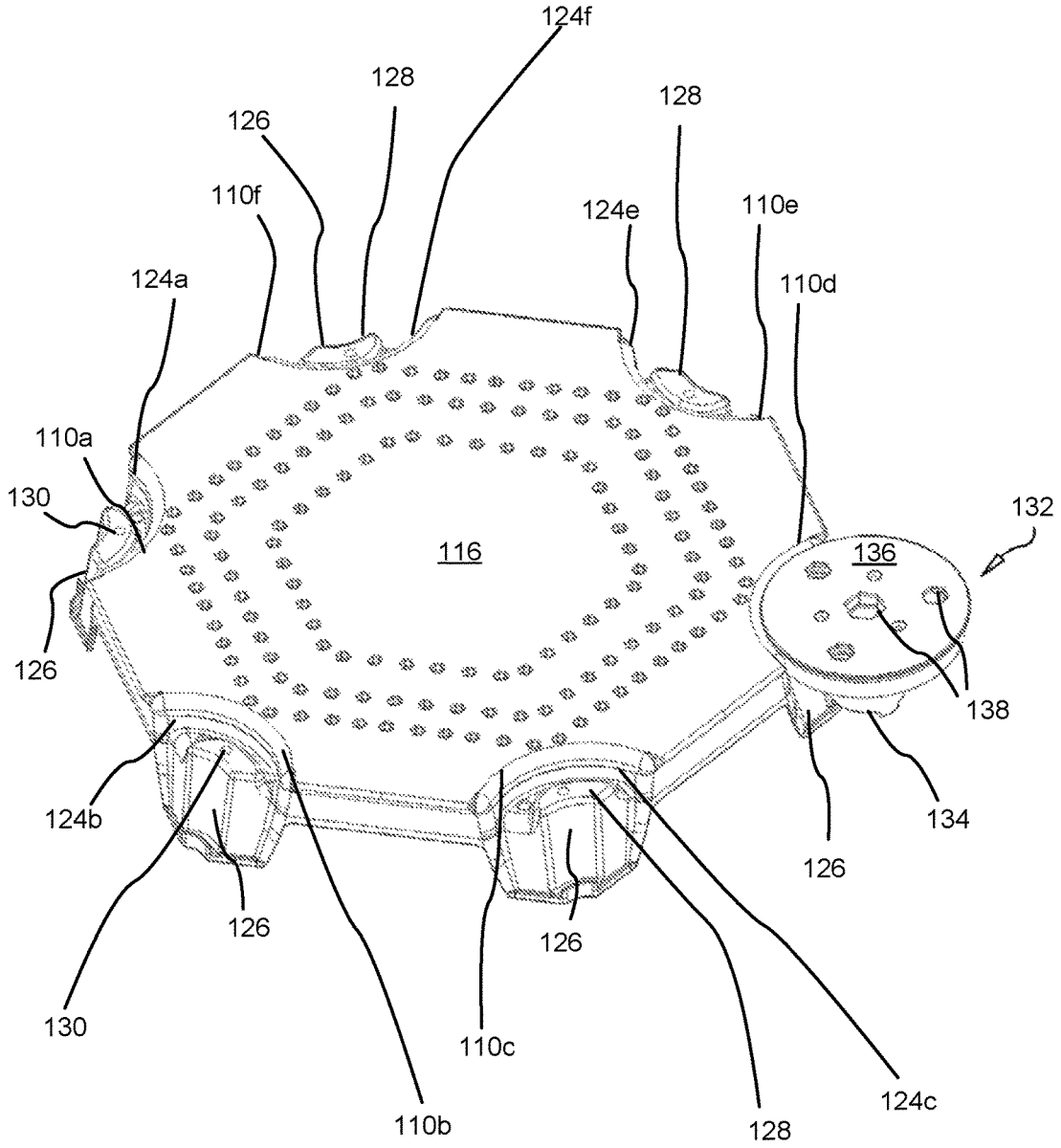
FIG. 4 is a top perspective view of a fastener locking the panel to the anchor in accordance with the present invention.

Turning now to FIG. 4, the system 100 further comprises at least one fastener 132 that is configured to rotatably fasten against the fastener receptacle 126 at the anchor recessions 124*a*-124*f* and the panel recessions 110*a*-110*f*. The fasteners 132 serve to restrict lateral movement between the panel 102 and the anchor 114. The fastener 132 also works with the fastener receptacle 126 for anchoring to the ground or wall surface. In one embodiment, six fasteners 132 engage six fastener receptacles 136.

Figure 5:
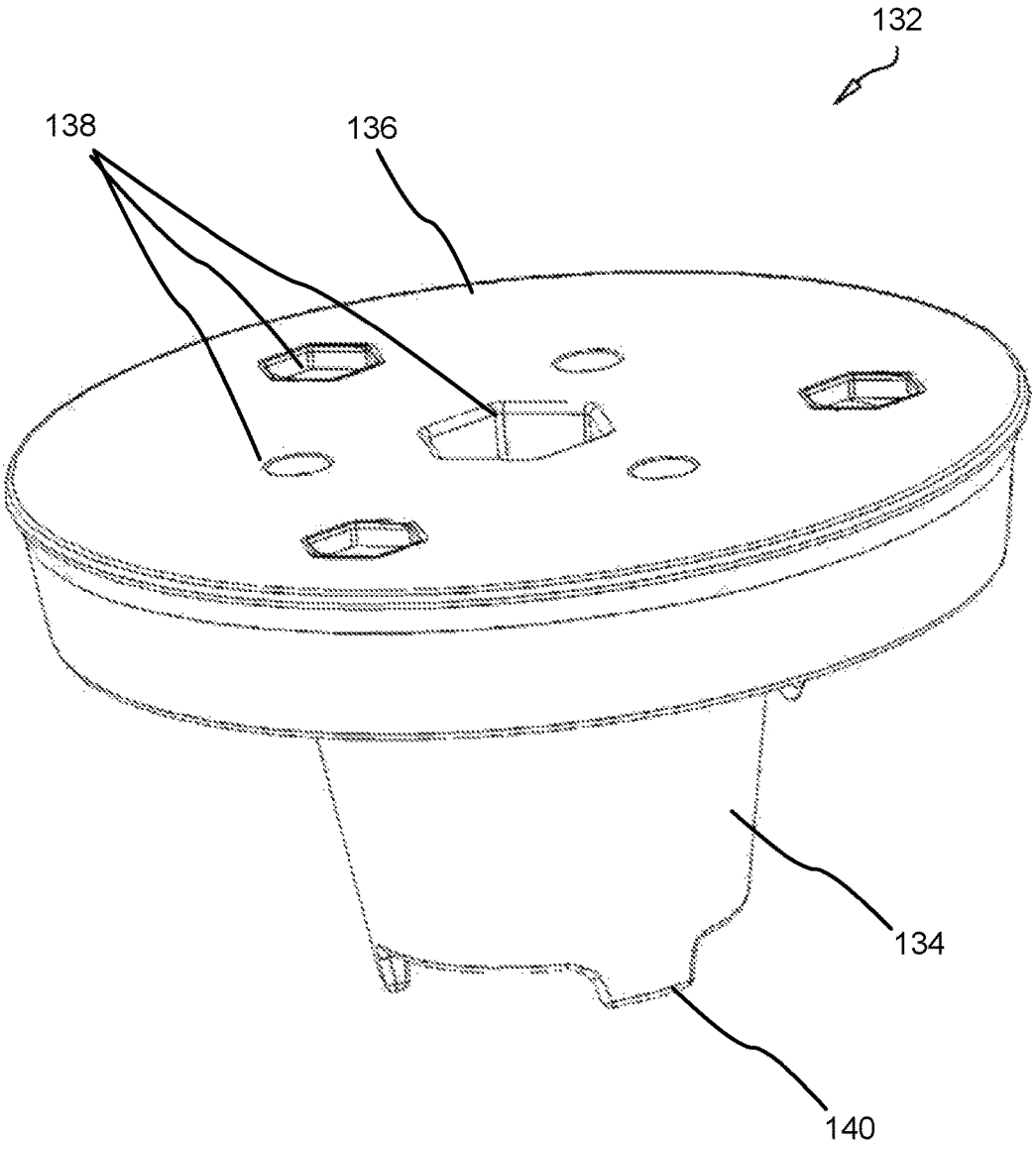
FIG. 5 is a top perspective view of a fastener having a base and a cap in accordance with the present invention.

FIG. 5 illustrates a perspective close-up view of the fastener 132. The fastener 132 comprises a base 136 having an elongated shape that is configured to at least partially pass through the fastener receptacle 126. The base 136 has a plurality of detents 140 configured on the outer surface of the base 136 to provide tactile feedback for when the fastener 132 is rotatably locked to the fastener receptacle 126. The fastener 132 utilizes frictional engagement and the detents 140 to form a snug fit with the fastener receptacle 126. In this manner, the panel 102 and the anchors 114 are securely held into place with minimal tools or skillsets needed.

Each fastener 132 passes through the panel recessions 110*a*-110*f* and the anchor recession 124*a*-124*f*, locking into place with the fastener receptacle 126 by means of a vertical 360° rotation. In one embodiment, detents 140 in the fastener 132 engage depressions in the fastener receptacle 126. The detents 140 provide tactile feedback once the turn is complete and the fastener 132 is locked into place. In one embodiment, the system 100 utilizes six fasteners 132 to engage six fastener receptacles 126. Additional fastening components may be used to further secure the fastener 132 to the anchor 114 and the panel 102.

Figure 6:
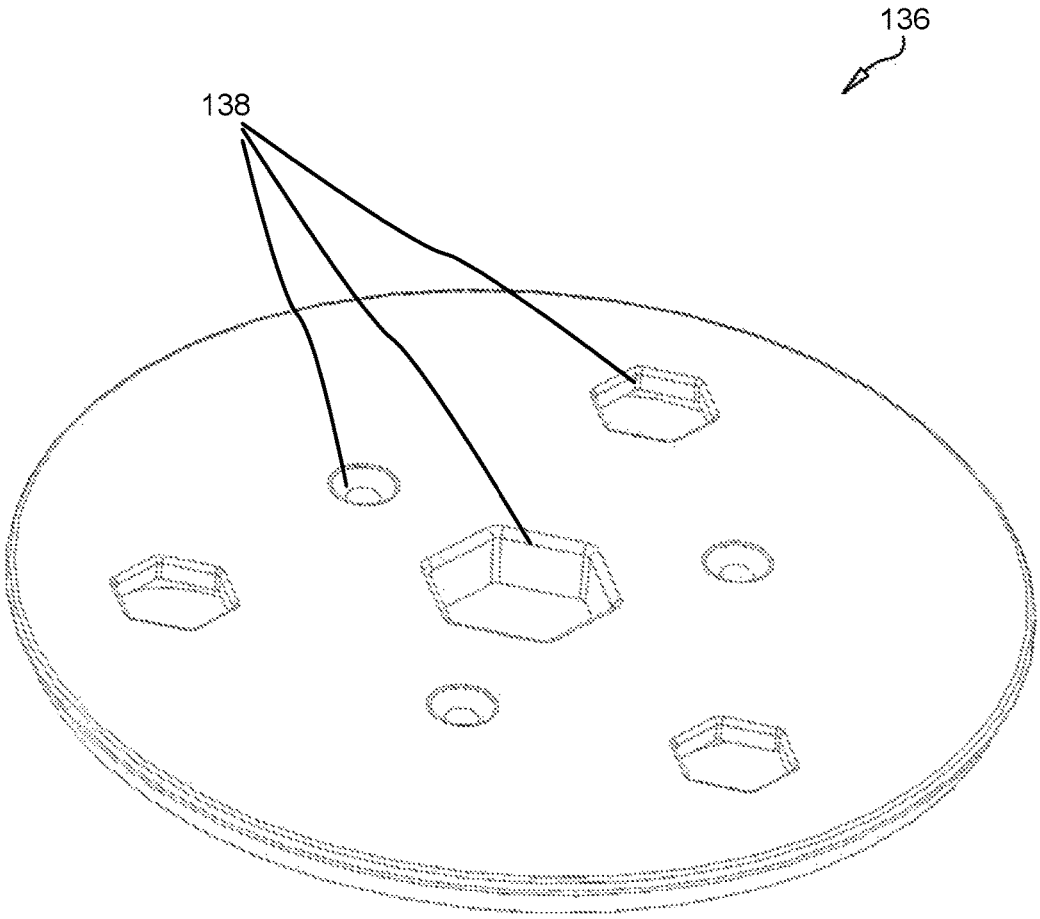
FIG. 6 is a top perspective view of a cap for a fastener in accordance with the present invention.

As shown in FIG. 6, the fastener 132 comprises a cap 136 that is disposed to overlay the base 136. The cap 136 comprising at least one cap hole 138. The cap hole 138 may have a variety of shapes, including, without limitation, circles, tear drops, hexagons, pentagons, and cubes. For example, FIG. 6 illustrates a central hexagonal-shaped cap hole 138 concentric to outer circular and smaller hexagonal holes. The at least one cap hole 138 is configured to align with the locking hole 130 of the protrusion 128 from the fastener receptacle 126.

Figure 7A:
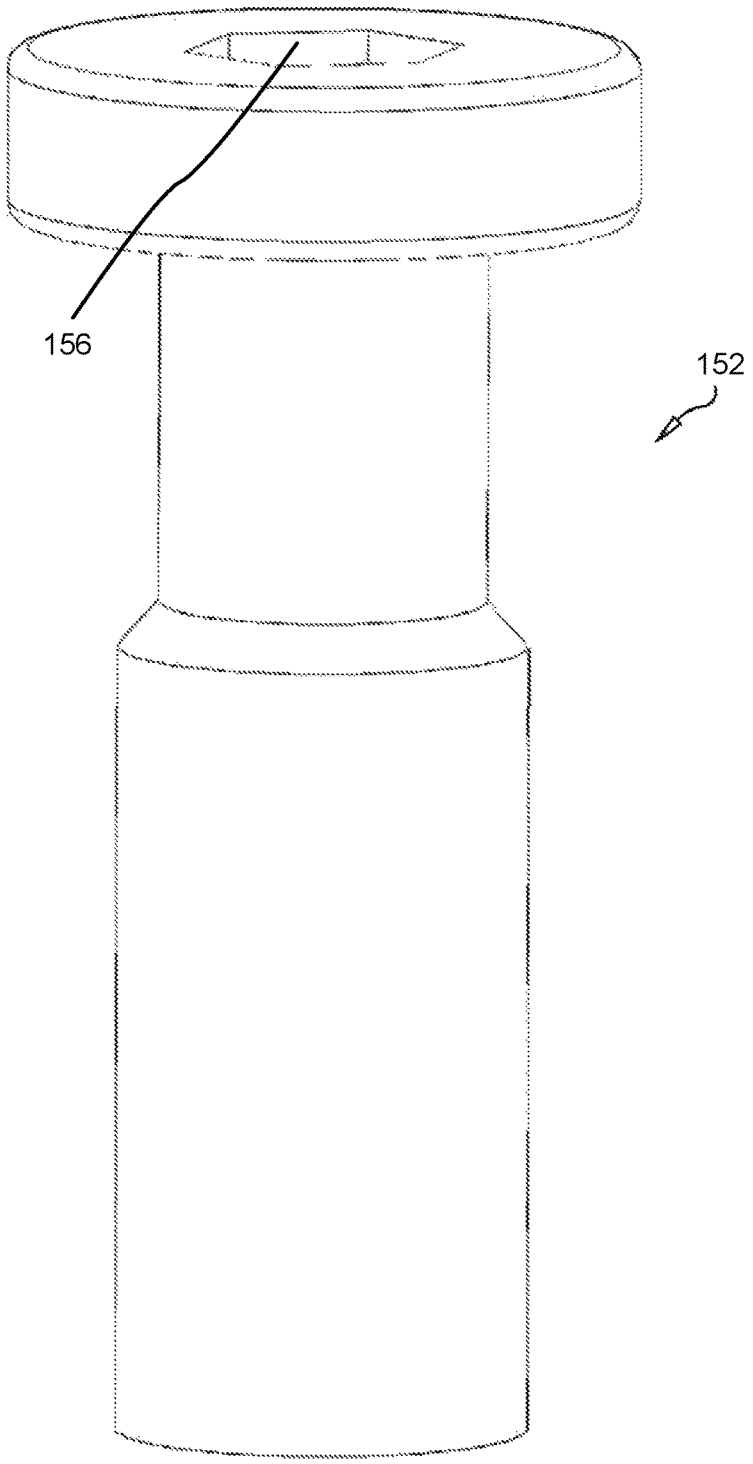
FIGS. 7A and 7B are side perspective views of a cap fastener and an Allen screw in accordance with the present invention.
Figure 7B:
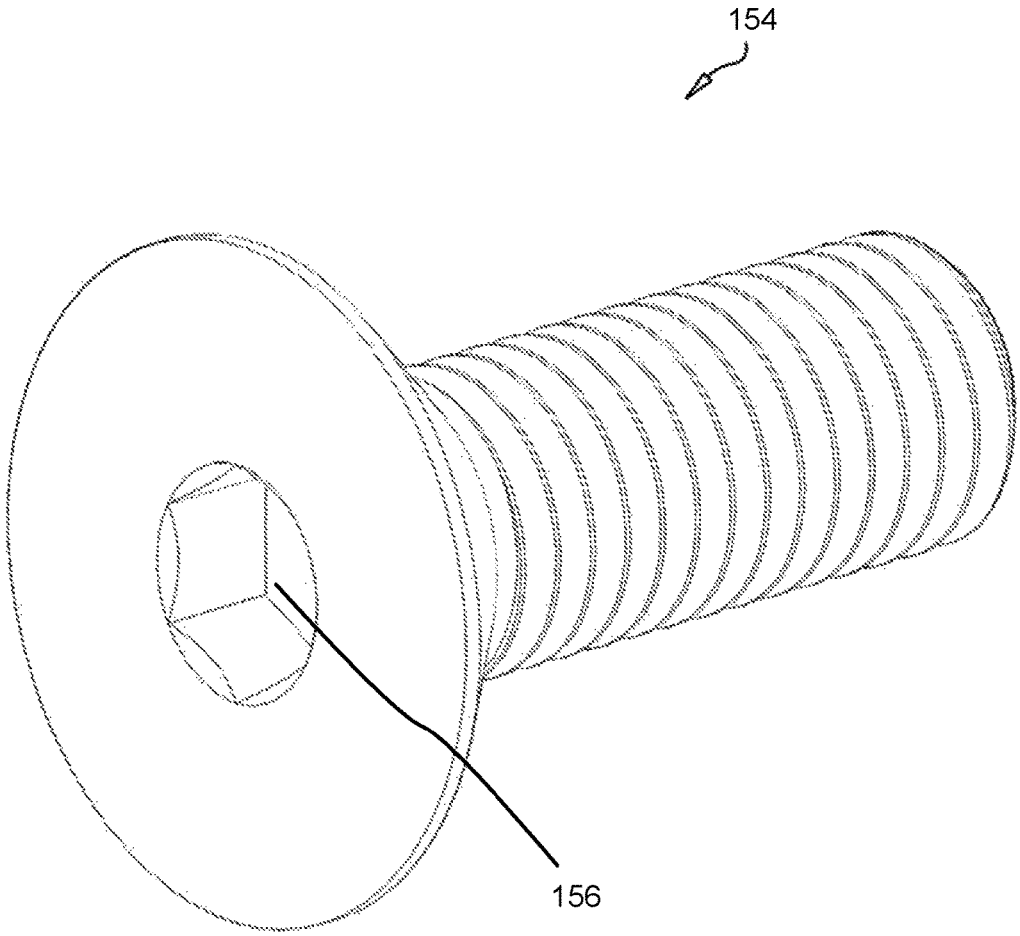

Once the cap hole 138 aligns with the locking hole 130 in the locking protrusion 128, then at least one cap fastener 152 (FIG. 7A), such as a screw, bolt, nail, and nut, can pass through the aligned cap hole 138 and the locking hole 130 to fasten the anchor 114 to both the panel 102 and the ground or wall surface. FIG. 7B illustrates an Allen screw 154, which is an alternative embodiment of the cap fastener 152. The cap fastener 152 comprises a cap fastener hole 156 that provides a grip for a wrench to rotatably fasten the cap fastener 152 or the Allen screw 154. It is significant to note that while having small structural differences, both types of cap fasteners 152, 154 enable rotatable tightening and loosening of the cap 136 relative to the base 136, and also fasten the fastener 132 to the fastener receptacle 126.

Figure 8:
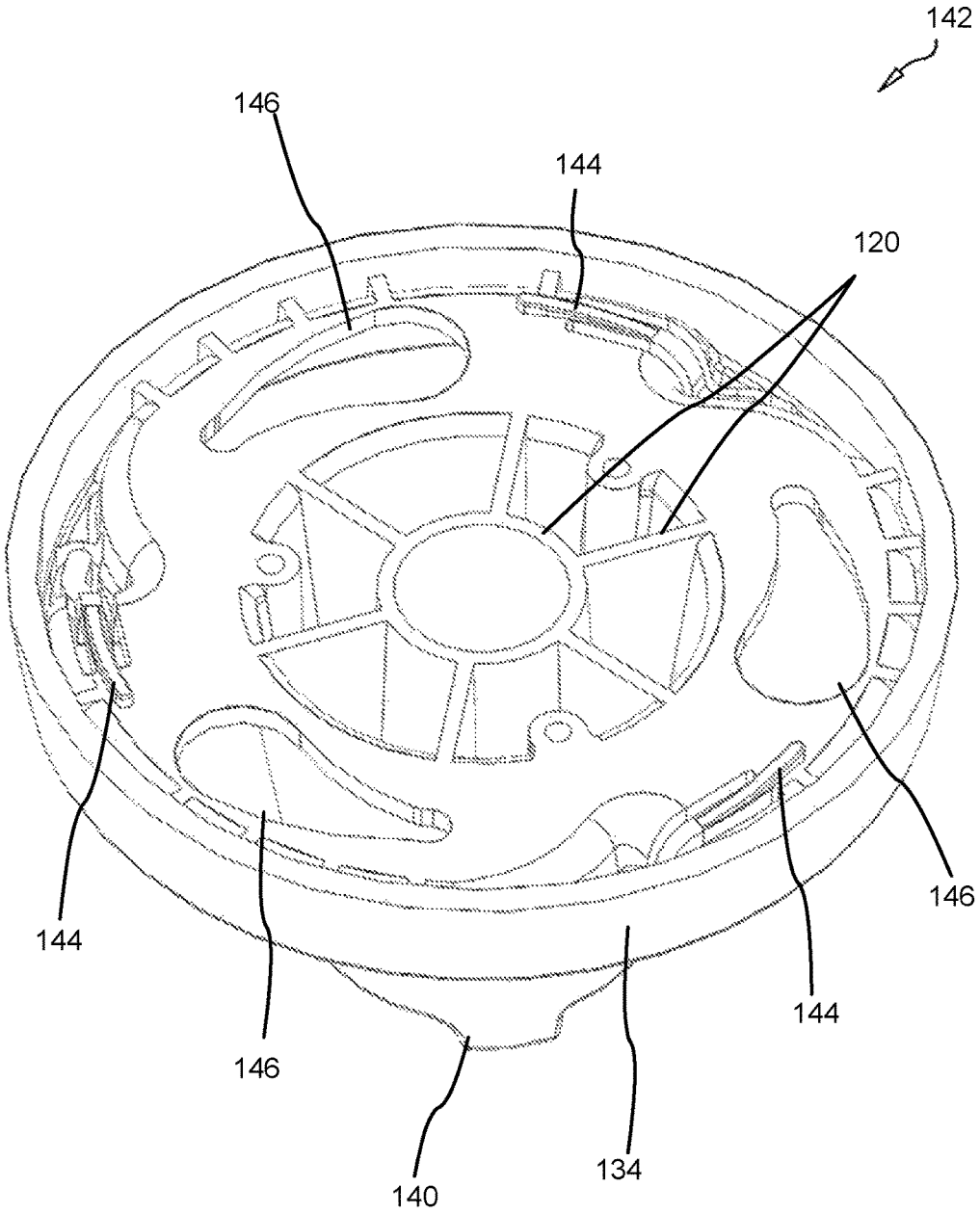
FIG. 8 is a top perspective view of a self-locking fastener with a self-locking cap removed from a self-locking base in accordance with the present invention.
Figure 9:
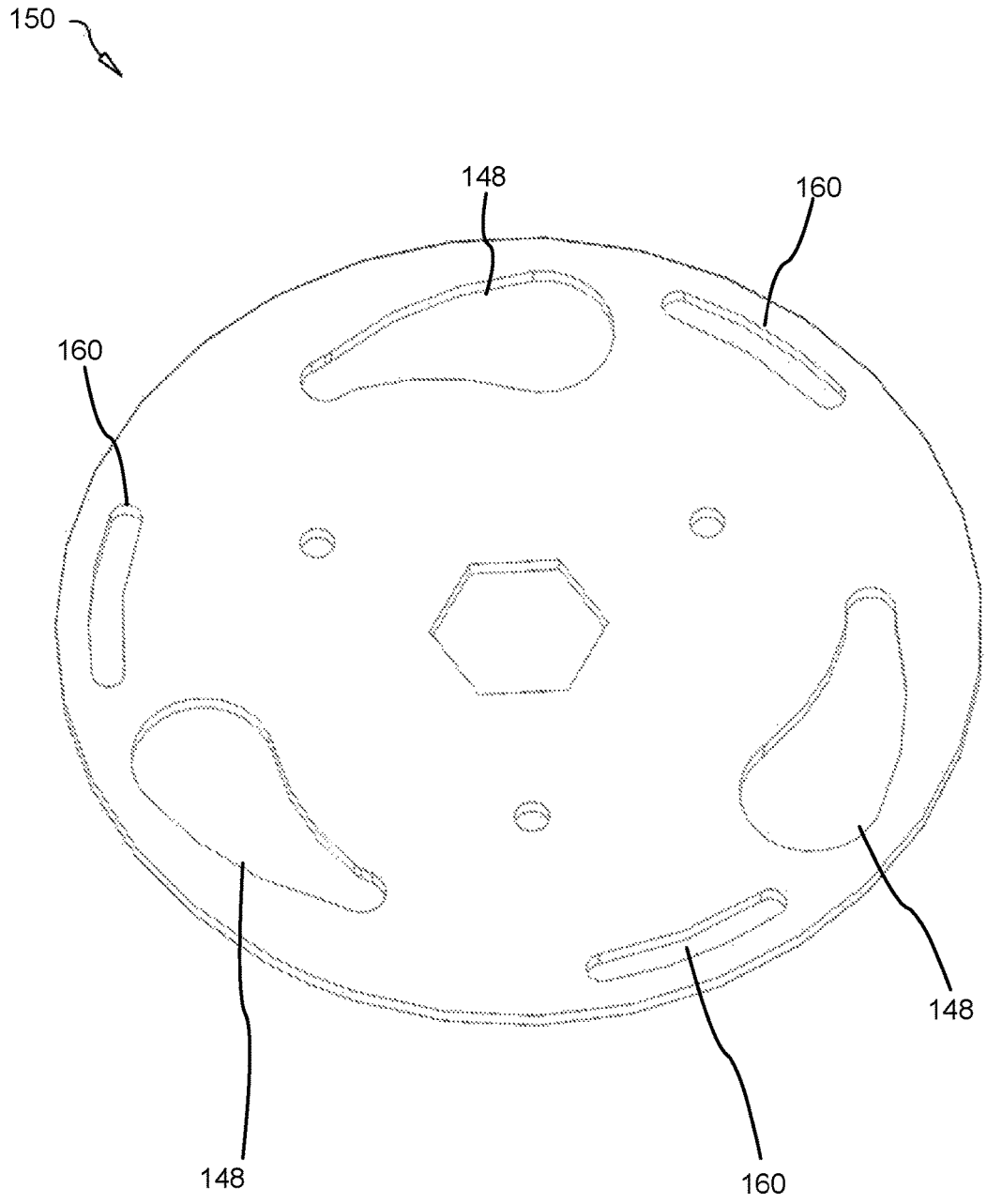
FIG. 9 is a top perspective view of a self-locking cap in accordance with the present invention.

FIGS. 8 and 9 illustrate an alternative embodiment of a self-locking fastener 142 having a self-locking base 158 with an internal clip 144 to attach a self-locking cap 150. The clip 144 is disposed inside the self-locking base 158. As the self-locking cap 150 is rotated, the clip 144 clamps down on a teardrop cap hole 148 on the self-locking cap 150 through a clip slot 160. The self-locking base 158 comprises a teardrop locking hole 146 that aligns with the teardrop cap hole 148. Once aligned, the self-locking fastener 142 can be made to attach the fastener receptacle 126 with the cap fastener 152. It is significant to note however, that the self-locking fastener 142, though having slightly different mechanisms, operates in substantially the same manner as the fastener 132 discussed above.

In some embodiments, the system 100 utilizes components that are precut and assembled with minimal tools or skillset. The system 100 is efficacious for constructing a solid, yet easily detachable and portable surfaces, for a deck, floor, wall, ceiling, or roof. Those skilled in the art will recognize that the modular, portable capacity of the system 100 provides numerous solutions to decking.

For example, renters, condominium owners, and secondary residences, such as cottages or trailers, can benefit from the interlocking and modular decking system 100. These users are ideally able to relocate, reconfigure, expand, or store the system 100, as needed. Additionally, the components of the system 100 are designed to be easily packaged on and within the dimensions of standardized palettes traditionally used for shipping and storage purposes.

Additionally, the universal, interlocking design of the system 100 allows for the addition of accessory components, consisting of, but not limited to: stairways, umbrellas, benches, tables, railings, storage bins, light fixtures, gazebos, planters, and other accessories. The accessories can be supported on the same anchors 114 that support the panel 102.

During installation of a deck utilizing the system 100, the area where the installation will take place is preferably level. Where minor discrepancies occur, the length of the fastener receptacles 126 on the anchor recessions 124*a*-124*f* can be increased or decreased, as needed. The fastener receptacles 126 from the anchors 114 may then penetrate the ground surface of the designated deck area for preparation to receive the panels 102. The panel 102 is then attached to the anchors 114 at the panel periphery 108 using the fastener 132 to hold the panels 102 in place against the anchor 114. The fasteners 132 are inserted into the fastener receptacles 126 of the anchor recessions 124*a*-124*f* and rotated up to 360°. A plurality of detents 140 in the base 136 of the fastener 132 provide tactile feedback once the locking rotation is complete and the fastener 132 locked into place.

Additional fastening components, such as screws or bolts, are passed through the locking hole 130 and cap hole 138 to enhance the attachment. Additional anchors 114 may be placed on the ground to receive additional panels 102. This installation process continues until the desired dimensions of the deck have been completed. The system 100 may be disassembled through simple removal of the fasteners 132, without requiring excessive force or breakage of the panels 102 or anchors 114.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A modular decking apparatus that assembles to form a deck, the deck being disassemblable and portable, the decking system comprising:

a plurality of hexagonal panels having a planar top surface, each panel defining six recesses circumscribing the top surface at evenly-spaced intervals, wherein each recess is shaped as a circular sector, each recess for receiving a fastener;

wherein each panel further defines a plurality of apertures on the top surface;

the panel further comprising six anchors affixed to a bottom surface of the panel, each of the six anchors comprising:

a fastener receptacle having a foot for engaging a ground surface which protrudes downwardly, each fastener receptacle circumscribing an outside edge of the anchor at evenly-spaced intervals, each fastener receptacle disposed beneath a recess;

a plurality of reinforced ribs disposed beneath the bottom surface, the plurality of reinforced ribs configured to enhance structural integrity of the panel;

the fastener receptacle comprising an upwardly-protruding locking protrusion for engaging a fastener, the locking protrusion defining at least one locking hole; and a plurality of fasteners, each fastener for interconnecting a plurality of panels, each fastener locking over locking protrusions on separate panels.

2. The apparatus of claim 1, wherein each fastener comprises a cylindrical base configured to abut a fastener receptacle, each fastener further comprising a cap configured to overlay the base, the cap defining at least one cap hole, wherein the at least one cap hole is configured to align with the at least one locking hole of the locking protrusion from the fastener receptacle for at least partially fastening the at the at least one anchor to the at least one panel.

3. The apparatus of claim 1, wherein the plurality of apertures in the at least one panel are drainage holes for liquid accumulating on the top surface.

4. The apparatus of claim 1, wherein the plurality of reinforced ribs comprise perpendicularly crossing beams.

5. The apparatus of claim 2, wherein the cylindrical base comprises a plurality of detents configured to frictionally engage the locking protrusion of the fastener receptacle.

6. The apparatus of claim 2, wherein the cap is substantially circular.

7. The apparatus of claim 2, wherein the at least one cap hole has a hexagonal shape.

8. The apparatus of claim 2, further comprising at least one cap fastener configured to pass through the at least one cap hole and the at least one locking hole.

9. The apparatus of claim 8, wherein the at least one cap fastener is a bolt.

10. The apparatus of claim 9, wherein the at least one cap fastener comprises a cap fastener hole configured to receive an Allen wrench.

11. The apparatus of claim 8, wherein the cap defines a plurality of teardrop-shaped locking holes.

* * * * *